US009175538B2

(12) United States Patent
Wordley et al.

(10) Patent No.: US 9,175,538 B2
(45) Date of Patent: Nov. 3, 2015

(54) RECHARGEABLE SYSTEM FOR SUBSEA FORCE GENERATING DEVICE AND METHOD

(75) Inventors: Mark Wordley, Magnolia, TX (US); Ryan Gustafson, Cypress, TX (US)

(73) Assignee: Hydril USA Distribution LLC, Houston, TX (US)

( * ) Notice: Subject to any disclaimer, the term of this patent is extended or adjusted under 35 U.S.C. 154(b) by 813 days.

(21) Appl. No.: 12/960,770

(22) Filed: Dec. 6, 2010

(65) Prior Publication Data

US 2012/0138159 A1 Jun. 7, 2012

(51) Int. Cl.

| | |
|---|---|
| ***E21B 34/14*** | (2006.01) |
| ***E21B 34/08*** | (2006.01) |
| ***E21B 43/12*** | (2006.01) |
| ***E21B 34/04*** | (2006.01) |
| ***E21B 33/035*** | (2006.01) |
| ***E21B 33/06*** | (2006.01) |
| ***E21B 33/064*** | (2006.01) |
| ***F04B 23/06*** | (2006.01) |

(52) U.S. Cl.

CPC ..... *E21B 33/0355* (2013.01); *E21B 33/06* (2013.01); *E21B 33/063* (2013.01); *E21B 33/064* (2013.01); *F04B 23/06* (2013.01); *Y10T 137/0402* (2015.04); *Y10T 137/86035* (2015.04)

(58) Field of Classification Search

CPC ... E21B 34/14; E21B 2034/007; E21B 34/08; E21B 43/12; E21B 2034/002; E21B 33/0355; E21B 34/04; E21B 21/106

USPC ..... 166/344, 345, 351, 363, 368, 373, 85.4; 137/315.02; 251/1.1, 1.2, 1.3

See application file for complete search history.

(56) References Cited

U.S. PATENT DOCUMENTS

| | | | | | |
|---|---|---|---|---|---|
| 2,721,446 | A | * | 10/1955 | Bumb | 60/415 |
| 2,747,370 | A | * | 5/1956 | Traut | 138/31 |
| 2,800,110 | A | * | 7/1957 | Haarmeyer | 91/420 |

(Continued)

FOREIGN PATENT DOCUMENTS

| | | | |
|---|---|---|---|
| WO | 01/66320 | A1 | 9/2001 |
| WO | 2008096170 | A1 | 8/2008 |
| WO | 2009/035945 | A1 | 3/2009 |

OTHER PUBLICATIONS

EP Partial Search Report dated Apr. 10, 2012 from corresponding EP Application No. 11191046.9.

(Continued)

*Primary Examiner* — Matthew Buck
*Assistant Examiner* — Edwin Toledo-Duran
(74) *Attorney, Agent, or Firm* — Bracewell & Giuliani LLP

(57) ABSTRACT

Method and recharging mechanism for resetting a pressure in a low pressure recipient. The recharging mechanism includes a low pressure recipient configured to have first and second chambers, the first chamber being configured to receive a hydraulic liquid at a high pressure and the second chamber being configured to include a gas at a low pressure. The recharging mechanism further includes a valve fluidly connected to a first port of the first chamber; a pumping device fluidly connected to a second port of the first chamber; and a blowout preventer (BOP) section fluidly connected to the valve and configured to close or open a ram block. The pumping device is configured to evacuate the hydraulic fluid from the first chamber of the low pressure recipient when the valve closes a fluid communication between the first port of the first chamber and the BOP section.

13 Claims, 9 Drawing Sheets

(56) References Cited

U.S. PATENT DOCUMENTS

| | | | | | |
|---|---|---|---|---|---|
| 3,163,985 | A | * | 1/1965 | Bouyoucos | 60/398 |
| 3,205,969 | A | * | 9/1965 | Clark | 181/142 |
| 3,208,357 | A | * | 9/1965 | Allen et al. | 92/27 |
| 3,436,914 | A | * | 4/1969 | Rosfelder | 60/398 |
| 3,595,012 | A | * | 7/1971 | Beck, Jr. | 60/398 |
| 3,654,995 | A | * | 4/1972 | Sizer | 166/313 |
| 3,677,001 | A | * | 7/1972 | Childers et al. | 60/398 |
| 3,750,404 | A | * | 8/1973 | Murman et al. | 60/413 |
| 3,921,500 | A | * | 11/1975 | Silcox | 91/4 R |
| 3,987,708 | A | * | 10/1976 | Uhrich | 92/134 |
| 4,095,421 | A | * | 6/1978 | Silcox | 60/398 |
| 4,109,725 | A | * | 8/1978 | Williamson et al. | 166/373 |
| 4,144,937 | A | * | 3/1979 | Jackson et al. | 166/373 |
| RE30,115 | E | * | 10/1979 | Herd et al. | 251/63.6 |
| 4,185,652 | A | * | 1/1980 | Zintz et al. | 137/78.2 |
| 4,205,594 | A | * | 6/1980 | Burke | 92/65 |
| 4,294,284 | A | * | 10/1981 | Herd | 137/613 |
| 4,367,794 | A | * | 1/1983 | Bednar et al. | 166/66.5 |
| 4,444,268 | A | * | 4/1984 | Barrington | 166/373 |
| 4,448,254 | A | * | 5/1984 | Barrington | 166/373 |
| 4,614,148 | A | * | 9/1986 | Bates | 91/420 |
| 4,777,800 | A | * | 10/1988 | Hay, II | 60/593 |
| 4,864,914 | A | * | 9/1989 | LeMoine | 91/29 |
| 5,044,440 | A | * | 9/1991 | Stinessen et al. | 166/344 |
| 5,062,349 | A | * | 11/1991 | Khan | 91/436 |
| 5,127,477 | A | * | 7/1992 | Schultz | 166/336 |
| 5,318,130 | A | * | 6/1994 | Manke | 166/373 |
| 5,357,999 | A | * | 10/1994 | Loth et al. | 137/81.2 |
| 5,564,912 | A | * | 10/1996 | Peck et al. | 417/396 |
| 6,006,647 | A | * | 12/1999 | Van Winkle | 91/41 |
| 6,192,680 | B1 | * | 2/2001 | Brugman et al. | 60/398 |
| 6,202,753 | B1 | * | 3/2001 | Baugh | 166/364 |
| 6,244,560 | B1 | * | 6/2001 | Johnson | 251/1.3 |
| 6,266,959 | B1 | * | 7/2001 | Markwart | 60/414 |
| 6,418,970 | B1 | * | 7/2002 | Deul | 138/31 |
| 6,622,672 | B1 | * | 9/2003 | Styron et al. | 123/78 E |
| 7,090,019 | B2 | * | 8/2006 | Barrow et al. | 166/361 |
| 7,159,662 | B2 | * | 1/2007 | Johansen et al. | 166/374 |
| 7,159,669 | B2 | * | 1/2007 | Bourgoyne et al. | 166/382 |
| 7,219,739 | B2 | * | 5/2007 | Robichaux | 166/355 |
| 7,231,981 | B2 | * | 6/2007 | Moe et al. | 166/355 |
| 7,314,087 | B2 | * | 1/2008 | Robichaux | 166/355 |
| 7,318,480 | B2 | * | 1/2008 | Hosie et al. | 166/367 |
| 7,424,917 | B2 | * | 9/2008 | Martin | 166/335 |
| 7,520,129 | B2 | * | 4/2009 | Springett | 60/398 |
| 7,628,207 | B2 | * | 12/2009 | Leonardi et al. | 166/364 |
| 7,663,256 | B2 | * | 2/2010 | Yuri et al. | 290/2 |
| 7,735,563 | B2 | * | 6/2010 | Judge et al. | 166/357 |
| 7,823,646 | B2 | * | 11/2010 | Ellis et al. | 166/355 |
| 7,891,429 | B2 | * | 2/2011 | Boyce et al. | 166/340 |
| 7,926,501 | B2 | * | 4/2011 | Springett et al. | 137/14 |
| 7,931,090 | B2 | * | 4/2011 | Smedstad et al. | 166/366 |
| 7,984,764 | B2 | * | 7/2011 | Leonardi et al. | 166/338 |
| 8,066,070 | B2 | * | 11/2011 | Springett et al. | 166/298 |
| 8,156,953 | B2 | * | 4/2012 | Tveita | 137/12 |
| 8,220,773 | B2 | * | 7/2012 | Gustafson | 251/1.1 |
| 8,322,435 | B2 | * | 12/2012 | Judge et al. | 166/357 |
| 8,376,051 | B2 | * | 2/2013 | McGrath et al. | 166/368 |
| 8,424,607 | B2 | * | 4/2013 | Springett et al. | 166/298 |
| 8,464,525 | B2 | * | 6/2013 | Springett et al. | 60/398 |
| 8,540,017 | B2 | * | 9/2013 | Ensley et al. | 166/85.4 |
| 8,544,538 | B2 | * | 10/2013 | Weir et al. | 166/85.4 |
| 8,563,484 | B2 | * | 10/2013 | Smith | 507/235 |
| 8,602,109 | B2 | * | 12/2013 | Gustafson | 166/373 |
| 8,720,564 | B2 | * | 5/2014 | Springett et al. | 166/297 |
| 8,720,565 | B2 | * | 5/2014 | Springett et al. | 166/297 |
| 8,727,018 | B1 | * | 5/2014 | McCulloch | 166/375 |
| 8,807,219 | B2 | * | 8/2014 | Springett et al. | 166/298 |
| 8,844,898 | B2 | * | 9/2014 | Weir | 251/1.3 |
| 2003/0037544 | A1 | * | 2/2003 | Armstrong | 60/413 |
| 2003/0178200 | A1 | * | 9/2003 | Fox et al. | 166/341 |
| 2006/0204375 | A1 | * | 9/2006 | Judge et al. | 417/393 |
| 2007/0204999 | A1 | * | 9/2007 | Cowie et al. | 166/368 |
| 2007/0205000 | A1 | * | 9/2007 | Hosie et al. | 166/374 |
| 2008/0104951 | A1 | * | 5/2008 | Springett | 60/413 |
| 2008/0185046 | A1 | * | 8/2008 | Springett et al. | 137/14 |
| 2009/0250224 | A1 | * | 10/2009 | Wright et al. | 166/373 |
| 2011/0297394 | A1 | * | 12/2011 | VanDelden | 166/373 |
| 2012/0000664 | A1 | * | 1/2012 | Nas et al. | 166/344 |
| 2012/0279720 | A1 | * | 11/2012 | Whitby et al. | 166/363 |

OTHER PUBLICATIONS

EP Search Report and Opinion dated Dec. 3. 2012 from corresponding EP Application No. 11191046.9.

* cited by examiner

RECHARGEABLE SYSTEM FOR SUBSEA FORCE GENERATING DEVICE AND METHOD

BACKGROUND

1. Technical Field

Embodiments of the subject matter disclosed herein generally relate to methods and devices and, more particularly, to mechanisms and techniques for recharging a device that generates a subsea force.

2. Discussion of the Background

During the past years, with the increase in price of fossil fuels, the interest in developing new production fields has dramatically increased. However, the availability of land-based production fields is limited. Thus, the industry has now extended drilling to offshore locations, which appear to hold a vast amount of fossil fuel.

The existing technologies for extracting the fossil fuel from offshore fields may use a system 10 as shown in FIG. 1. More specifically, the system 10 may include a vessel 12 having a reel 14 that supplies power/communication cords 16 to a controller 18. A Mux Reel may be used to transmit power and communication. Some systems have hose reels to transmit fluid under pressure or hard pipe (rigid conduit) to transmit the fluid under pressure or both. Other systems may have a hose with communication or lines (pilot) to supply and operate functions subsea. However, a common feature of these systems is their limited operation depth. The controller 18 is disposed undersea, close to or on the seabed 20. In this respect, it is noted that the elements shown in FIG. 1 are not drawn to scale and no dimensions should be inferred from FIG. 1.

FIG. 1 also shows a wellhead 22 of the subsea well 23 and a drill line 24 that enters the subsea well 23. At the end of the drill line 24 there is a drill (not shown). Various mechanisms, also not shown, are employed to rotate the drill line 24, and implicitly the drill, to extend the subsea well.

However, during normal drilling operation, unexpected events may occur that could damage the well and/or the equipment used for drilling. One such event is the uncontrolled flow of gas, oil or other well fluids from an underground formation into the well. Such event is sometimes referred to as a "kick" or a "blowout" and may occur when formation pressure exceeds the pressure of the column of drilling fluid. This event is unforeseeable and if no measures are taken to prevent it, the well and/or the associated equipment may be damaged.

Thus, a pressure controlling device, for example, a blowout preventer (BOP), might be installed on top of the well to seal the well in case that the integrity of the well is affected. The BOP is conventionally implemented as a valve to prevent the release of pressure either in the annular space between the casing and the drill pipe or in the open hole (i.e., hole with no drill pipe) during drilling or completion operations. FIG. 1 shows BOPs 26 or 28 that are controlled by the controller 18, commonly known as a POD. The controller 18 controls an accumulator 30 to close or open BOPs 26 and 28. More specifically, the controller 18 controls a system of valves (not shown) for opening and closing the BOPs. Hydraulic fluid, which is used to open and close the valves, is commonly pressurized by equipment on the surface. The pressurized fluid is stored in accumulators on the surface and subsea to operate the BOPs. The fluid stored subsea in accumulators may also be used to shear and/or to support acoustic functions when the control of the well is lost. The accumulator 30 may include containers (canisters) that store the hydraulic fluid under pressure and provide the necessary pressure to open and close the BOPs. The pressure from the accumulator 30 is carried by pipe 32 to BOPs 26 and 28.

As understood by those of ordinary skill in the art, in deep-sea drilling, in order to overcome the high hydrostatic pressures generated by the seawater at the depth of operation of the BOPs, the accumulator 30 has to be initially charged to a pressure above the ambient subsea pressure. Typical accumulators are charged with nitrogen but as precharge pressures increase, the efficiency of nitrogen decreases which adds additional cost and weight because more accumulators are required subsea to perform the same operation on the surface. For example, a 60-liter (L) accumulator on the surface may have a useable volume of 24 L on the surface but at 3000 m of water depth the usable volume is less than 4 L. To provide that additional pressure deep undersea is expensive, the equipment for providing the high pressure is bulky, as the size of the canisters that are part of the accumulator 30 is large, and the range of operation of the BOPs is limited by the initial pressure difference between the charge pressure and the hydrostatic pressure at the depth of operation.

In this regard, FIG. 2 shows the accumulator 30 connected via valve 34 to a cylinder 36. The cylinder 36 may include a piston (not shown) that moves when a first pressure on one side of the piston is higher than a second pressure on the other side of the piston. The first pressure may be the hydrostatic pressure plus the pressure released by the accumulator 30 while the second pressure may be the hydrostatic pressure. Therefore, the use of pressured canisters to store high-pressure fluids to operate a BOP make the operation of the offshore rig expensive and require the manipulation of large parts.

As discussed above with regard to FIG. 2, the accumulator 30 is bulky because of the low efficiency of nitrogen at high pressures. As the offshore fields are located deeper and deeper (in the sense that the distance from the sea surface to the seabed is becoming larger and larger), the nitrogen based accumulators become less efficient given the fact that the difference between the initial charge pressure to the local hydrostatic pressure decreases for a given initial charge, thus, requiring the size of the accumulators to increase (it is necessary to use 16 320-L bottles or more depending on the required shear pressure and water depth), and increasing the price to deploy and maintain the accumulators.

As disclosed in U.S. patent application Ser. No. 12/338,652, filed on Dec. 18, 2008, entitled "Subsea Force Generating Device and Method" to R. Gustafson, the entire disclosure of which is incorporated herein, a novel arrangement, as shown in FIG. 3, may be used to generate the force F. FIG. 3 shows an enclosure 36 that includes a piston 38 capable of moving inside the enclosure 36. The piston 38 divides the enclosure 36 into a chamber 40, defined by the cylinder 36 and the piston 38. Chamber 40 is called the closing chamber. Enclosure 36 also includes an opening chamber 42 as shown in FIG. 3. The enclosure 36 may be formed in a BOP and the opening chamber 42 and the closing chamber 40 actuate the ram block (not shown) connected to rod 44.

The pressure in both chambers 40 and 42 may be the same, i.e., the sea pressure (ambient pressure). The ambient pressure in both chambers 40 and 42 may be achieved by allowing the sea water to freely enter these chambers via corresponding valves (not shown). Thus, as there is no pressure difference on either side of the piston 38, the piston 38 is at rest and no force F is generated.

When a force is necessary to be supplied for activating a piece of equipment, the rod 44 associated with the piston 38 has to be moved. This may be achieved by generating a pressure imbalance on two sides of the piston 38.

Although the arrangement shown in FIG. 3 and described in patent application Ser. No. 12/338,652, to R. Gustafson discloses how to generate the undersea force without the use of the accumulators, however, as discussed later, the accumulators still may be used to supply a supplemental pressure. FIG. 3 shows that the opening chamber 42 may be connected to a low pressure recipient 60. A valve 62 may be inserted between the opening chamber 42 and the low pressure recipient 60 to control the pressures between the opening chamber 42 and the low pressure recipient 60.

As shown in FIG. 3, when there is no need to supply the force, the pressure in both the closing and opening chambers is $P_{amb}$ while the pressure inside the recipient 60 is approximately $P_r$=1 atm or lower to improve efficiency. When a force is required for actuation of a piece of equipment of the rig, for example, a ram block of the BOP, the seawater is prevented to enter the opening chamber 42 and valve 62 opens such that the opening chamber 42 may communicate with the low pressure recipient 60. The following pressure changes take place in the closing chamber 40, the opening chamber 42 and the low pressure recipient 60. The closing chamber 40 remains at the ambient pressure as more seawater enters via pipe 64 to the closing chamber 40 as the piston 38 starts moving from left to right in FIG. 4. The pressure in the opening chamber 42 decreases as the low pressure $P_r$ becomes available via the valve 62, i.e., seawater from the opening chamber 42 moves to the low pressure recipient 60 to equalize the pressures between the opening chamber 42 and the low pressure recipient 60. Thus, a pressure imbalance occurs between the closing chamber 40 and the opening chamber 42 (which is now sealed from the ambient) and this pressure imbalance triggers the movement of the piston 38 to the right in FIG. 3, thus generating the force F.

One feature of the device shown in FIG. 3 is the fact that the low pressure recipient 60 has a limited functionality. More specifically, once the seawater from the opening chamber 42 was released into the low pressure recipient 60 and the opening chamber 42 was sealed from ambient, the low pressure recipient 60 cannot again supply the low pressure unless a mechanism is implemented to empty the low pressure recipient 60 of the received sea water. In other words, the seawater that occupies the low pressure recipient 60 after valve 62 has been opened, has to be removed and the gas at the atmospheric pressure that existed in the low pressure recipient 60 prior to opening the valve 62 has to be reestablished for recharging the low pressure recipient 60.

According to an exemplary embodiment and as shown in FIG. 4, the low pressure recipient 60 may be reused by providing a reset recipient 70 connected to the low pressure recipient 60, as described in U.S. patent application Ser. No. 12/338,669, filed on Dec. 18, 2008, entitled "Rechargeable Subsea Force Generating Device and Method" to R. Gustafson, the entire disclosure of which is incorporated herein. The reset recipient 70 and the low pressure recipient 60 may be formed integrally, i.e., in one piece. FIG. 4 shows the low pressure recipient 60 and the reset recipient 70 formed in a single reset module 72.

The low pressure recipient 60 may include a movable piston 74 that defines a low pressure gas chamber 76. This low pressure gas (or vacuum) chamber 76 is the chamber that is filled with gas (air for example) at atmospheric pressure and provides the low pressure to the opening chamber 42 of the BOP. The low pressure recipient 60 may include a port 78, which may be a hydraulic return port to the BOP.

A piston assembly 80 penetrates into the low pressure recipient 60. The piston assembly 80 is provided in the reset recipient 70. The piston assembly 80 includes a piston 82 and a first extension element 84. The piston 82 is configured to move inside the reset recipient 70 while the first extension element 84 is configured to enter the low pressure recipient 60 to apply a force to the piston 74. The piston 82 divides the reset recipient 70 into a reset opening retract chamber 86 and a reset closing extend chamber 88. The reset opening retract chamber 86 is configured to communicate via a port 90 with a pressure source (not shown). The reset closing extend chamber 88 is configured to communicate via a port 92 to the pressure source or another pressure source. The release of the pressure from the pressure source to the reset recipient 70 may be controlled by valves 94 and 96. A solid wall 98 may be formed between the low pressure recipient 60 and the reset recipient 70 to separate the two recipients. A second extension element 100 of the piston 82 may be used to lock the piston 82. The piston 82 may be locked in a desired position by a locking mechanism 102. Mechanisms for locking a piston are know in the art, for example, Hydril Multiple Position Locking (MPL) clutch, from Hydril Company LP, Houston, Tex. or other locking device such as a collet locking device or a ball grip locking device.

However, it would be desirable to provide other systems and methods for recharging the low pressure recipient.

SUMMARY

According to one exemplary embodiment, there is a recharging mechanism for resetting a pressure in a low pressure recipient connected to a subsea pressure control device. The recharging mechanism includes the low pressure recipient configured to have first and second chambers, the first chamber being configured to receive a hydraulic liquid at a high pressure and the second chamber being configured to include a gas at a low pressure; a valve fluidly connected to a first port of the first chamber of the low pressure recipient; a pumping device fluidly connected to a second port of the first chamber of the low pressure recipient; and a blowout preventer (BOP) section fluidly connected to the valve and configured to close or open a ram block. The pumping device is configured to evacuate the hydraulic fluid from the first chamber of the low pressure recipient when the valve closes a fluid communication between the first port of the first chamber and the BOP section.

According to another exemplary embodiment, there is a pumping device configured to reestablish a low pressure in a low pressure recipient connected to a subsea pressure control device. The pumping device includes first and second enclosures connected to each other by a passage; a piston provided in the first enclosure to split the first enclosure in first and second chambers; a first port connected to the first chamber and configured to fluidly communicate with a source of high pressure; a second port connected to the second chamber and configured to fluidly communicate with the source of high pressure; and a rod connected to the piston and configured to extend through the first enclosure, the passage and the second enclosure in such a way that a fluid from the second enclosure is prevented to enter the first enclosure.

According to still another exemplary embodiment, there is a method for reestablishing a low pressure in a low pressure recipient with a pumping device. The method includes a step of connecting first and second enclosures of the pumping device to each other by a passage; a step of providing a piston in the first enclosure that splits the first enclosure in first and second chambers; a step of connecting a first port to the first chamber to fluidly communicate with a source of high pressure; a step of connecting a second port to the second chamber to fluidly communicate with the source of high pressure; and a step of connecting a rod to the piston to extend through the first enclosure, the passage and the second enclosure in such a way that a fluid from the second enclosure is prevented to enter the first enclosure.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of BOP systems. However, the embodiments to be discussed next are not limited to these systems, but may be applied to other systems that require the repeated supply of force when the ambient pressure is high such as in a subsea environment, as for example a subsea pressure control device.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a novel way to recharge a low pressure recipient is discussed next. According to this embodiment, a pump may be connected to the low pressure recipient to remove the seawater or other fluid and reestablish a low pressure of a gas inside the low pressure recipient. The pump may be configured to vent into the sea the seawater from the low pressure recipient or to recirculate the seawater. The pump may be configured to handle one or more low pressure recipients. The pump may be placed undersea, next to the low pressure recipient or on a ship above the well.

Figure 1:
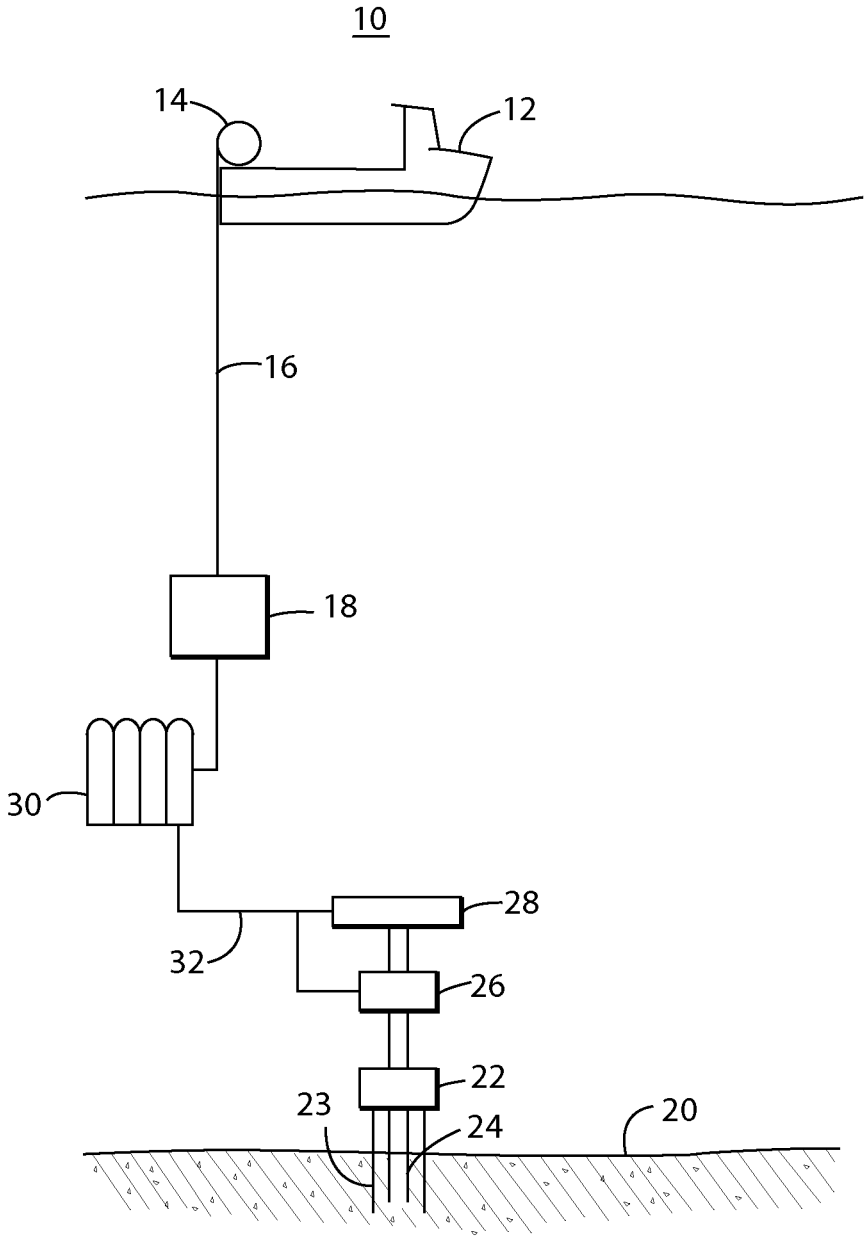
Figure 1 Background Art
FIG. 1 is a schematic diagram of a conventional offshore rig.
Figure 2:
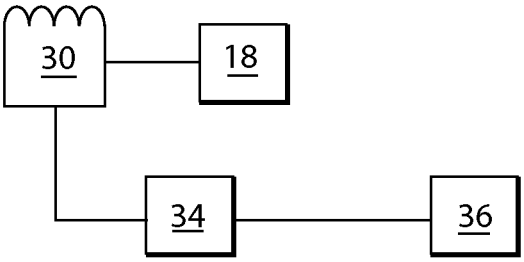
Figure 2 Background Art
FIG. 2 is a schematic diagram of an accumulator for generating an undersea force.
Figure 3:
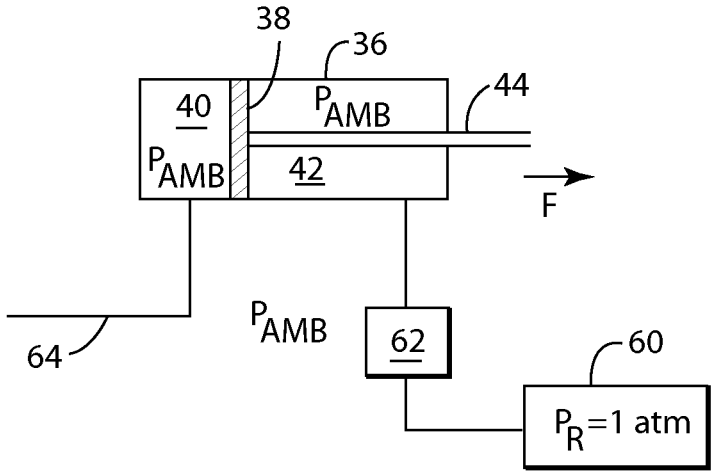
FIG. 3 is a schematic diagram of a low pressure recipient connected to a BOP.
Figure 4:
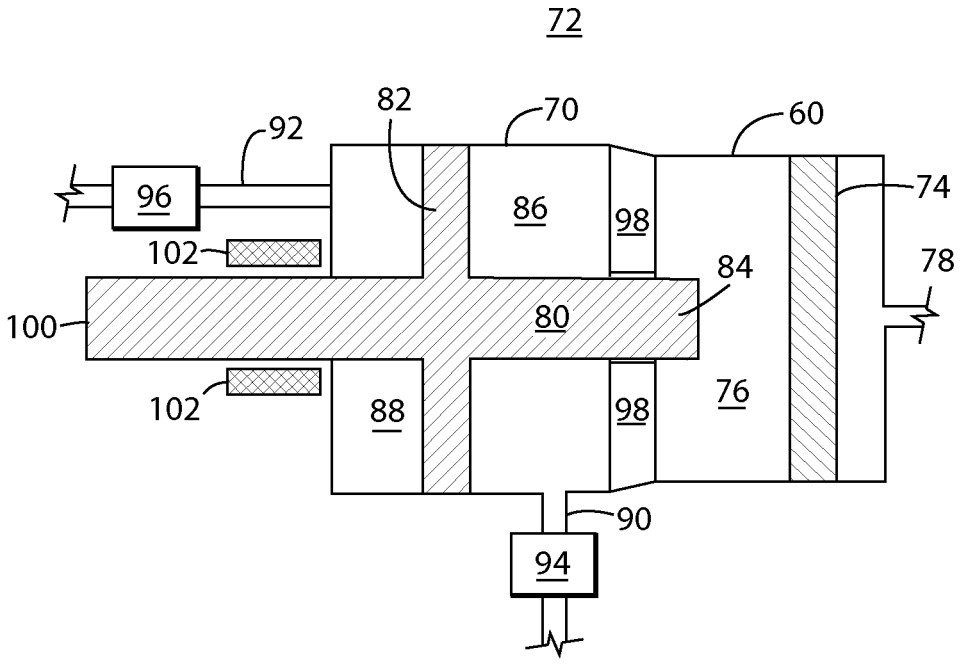
FIG. 4 is a schematic diagram of a device for recharging a low pressure recipient.
Figure 5:
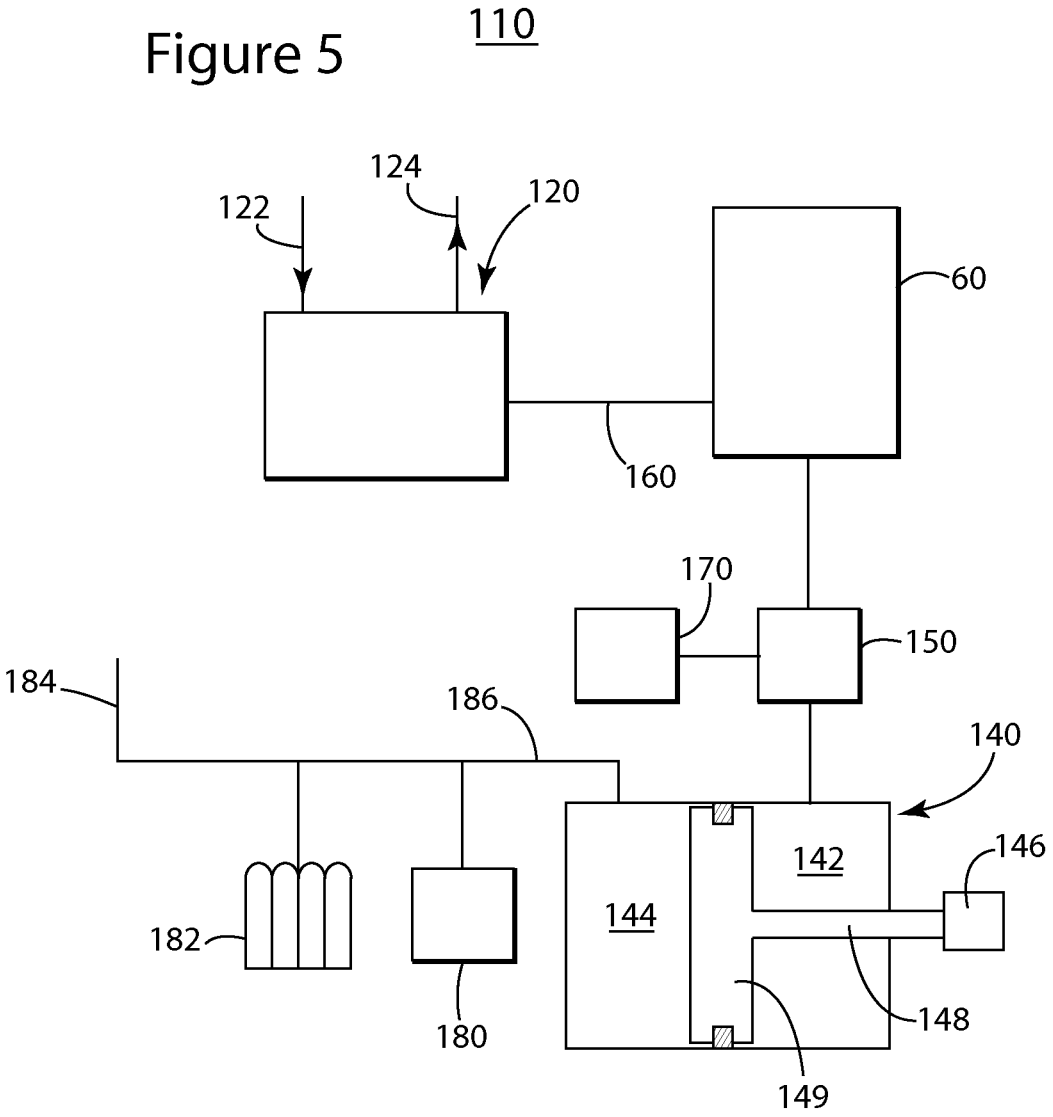
FIG. 5 is a schematic diagram of a pumping system for recharging a low pressure recipient according to an exemplary embodiment.

According to an exemplary embodiment illustrated in FIG. 5, a recharging system 110 may include the low pressure recipient 60, a pumping device 120, a BOP section 140, and a valve 140. The pumping device 120 may have ports 122 and 124 that activate the pumping device for removing the seawater from the low pressure recipient 60. A fluid connection 160 (e.g., pipe) is provided between the pumping device 120 and the low pressure recipient 60.

Valve 150 is configured to place in fluid communication the low pressure recipient 60 with an opening chamber 142 the BOP section 140 and also to allow a pressure source 170 to provide pressure to the BOP section 140, as will be discussed later. Another pressure source may be connected to a closing chamber 144 of the BOP section 140 and this pressure source may include another low pressure recipient 180, one or more accumulators 182, and/or a pipe 184 connected to a ship (not shown) at the sea level. All these power sources are connected to a port 186 of the BOP section 140. Pipe 184 may be connected to a pump provided on the ship. BOP section 140 is part of a BOP and includes the closing and opening mechanism for a ram block 146 that is connected via a rod 148 to a piston 149. The pressure differences on the piston 149, pressures created in the closing chamber 144 and the opening chamber 142, determine the movement direction of the ram block 146.

Figure 6:
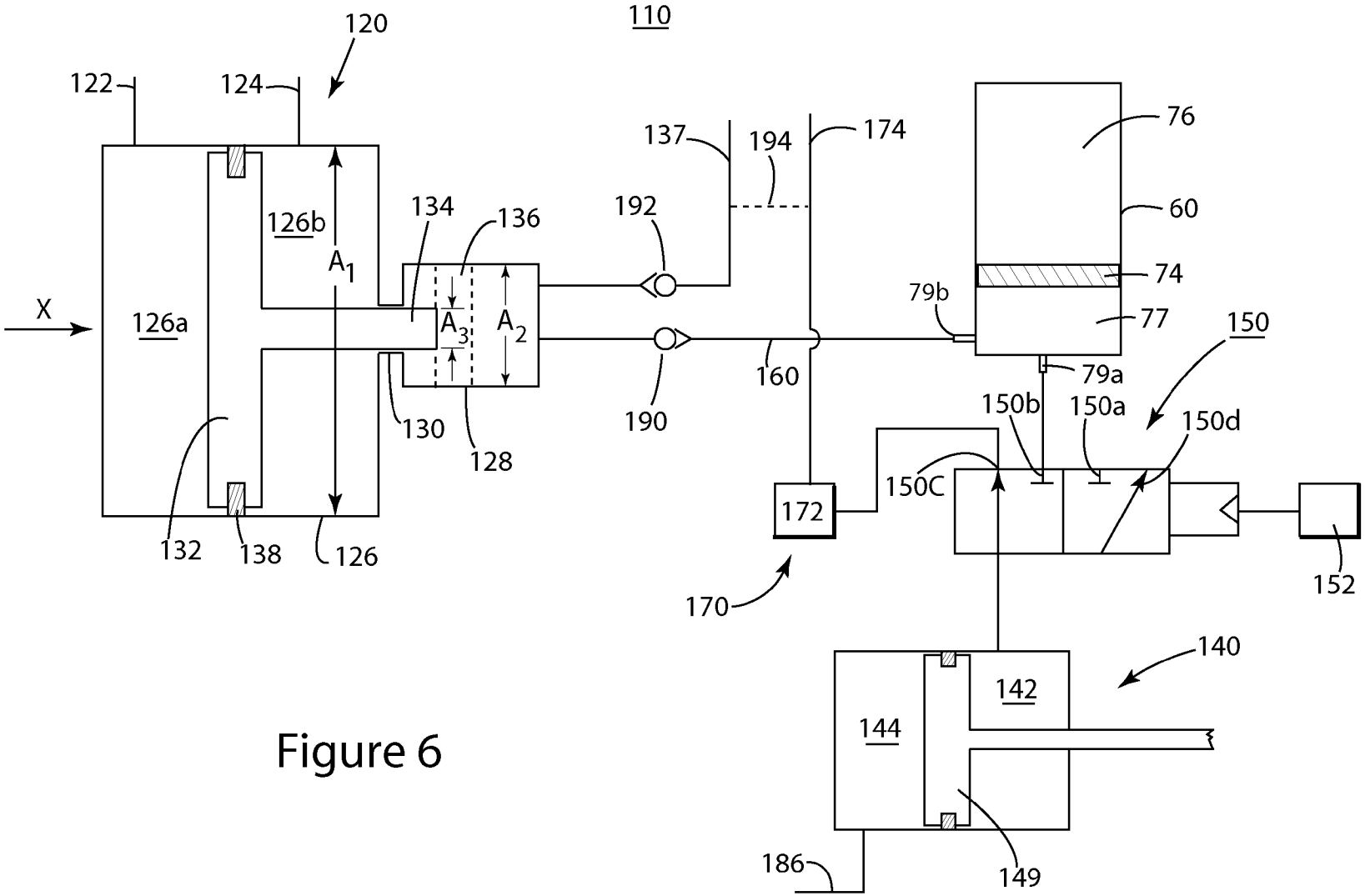
FIG. 6 is a more detailed schematic diagram of a pumping system for recharging a low pressure recipient according to an exemplary embodiment.

According to an exemplary embodiment illustrated in FIG. 6, the low pressure recipient 60 has a piston 74 that separates gas chamber 76 from chamber 77. However, according to another exemplary embodiment, the piston 74 may be removed as the gas in the gas chamber 76 separates from a fluid in the chamber 77 due, for example, to gravity. Gas chamber 76 is configured to hermetically seal a gas provided in this chamber. The gas is provided at sea level to have a pressure around 1 atm. One possible gas is air. However, it is possible to provide vacuum in gas chamber 76. Optional piston 74 is provided with seals (not shown) where contacting the inside wall of the low pressure recipient 60 to prevent an escape of the gas from gas chamber 76 or to prevent sea water (or other fluid) from chamber 77 entering the gas chamber 76. Thus, in one application, gas chamber 76 is completely isolated from ambient or other mediums, i.e., there are no ports or valves connected to the gas chamber 76. On the contrary, chamber 77 is connected via a first port 79*a* to the valve 150 and to the BOP section 140 and via a second port 79*b* to pipe 160 and to the pumping device 120.

Pumping device 120 may include a pump or a similar device that is capable of moving a fluid. According to an exemplary embodiment, the pumping device 120 includes a first enclosure 126 and a second enclosure 128 connected to each other via a passage 130. The first enclosure 126 has a larger cross-sectional area A1 than a cross-sectional area A2 of the second enclosure 128. The cross-sectional areas A1 and A2 represent the area of each of the enclosures taken substantially perpendicular on axis X along which a piston 132 moves inside the first enclosure 126. Piston 132 is connected to a rod 134 that extends in the first enclosure 126, the passage 130, and the second enclosure 128. A cross-sectional area A3 of the rod 134 may be smaller than area A2. Optionally, a piston 136 having area A3 may be connected to the rod 134. Areas A1 to A3 may be chosen to amplify the effect on the pump. By providing an appropriate pressure at ports 122 and/or 124, the piston 132 is forced to move along axis X. Thus, rod 134 moves inside the second chamber 128 to absorb fluid from chamber 77 and to discharge the absorbed fluid outside the pumping device 120.

A movement of the rod 134 along a direction opposite to X absorbs the seawater from chamber 77 of the low pressure recipient 60. A movement of the rod 134 along X forces the seawater absorbed from chamber 77 along pipe 137. Valves 190 and 192 (directional valves configured to allow a flow only in one direction) prevent the seawater from entering back into chamber 77 or absorbing the seawater along pipe 137. Pipe 137 may be configured to release the seawater in the ambient or may send the seawater along pipe 194 and 174 to the pressure source 170. Piston 132 may have a seal 138 for reducing fluid communication between the chambers 126*a* and 126*b* of the first enclosure 126.

Chamber 77 of the low pressure recipient 60 also communicates with valve 150. Valve 150 may be a conventional sub plate mounted (SPM) valve or other known valve. An SPM valve is actuated between the various positions by a pilot valve 152. The pilot valve 152 may be a solenoid valve (electrically activated valve). The pilot valve 152 is connected to the SPM valve 150 as shown in the figure.

Figure 7:
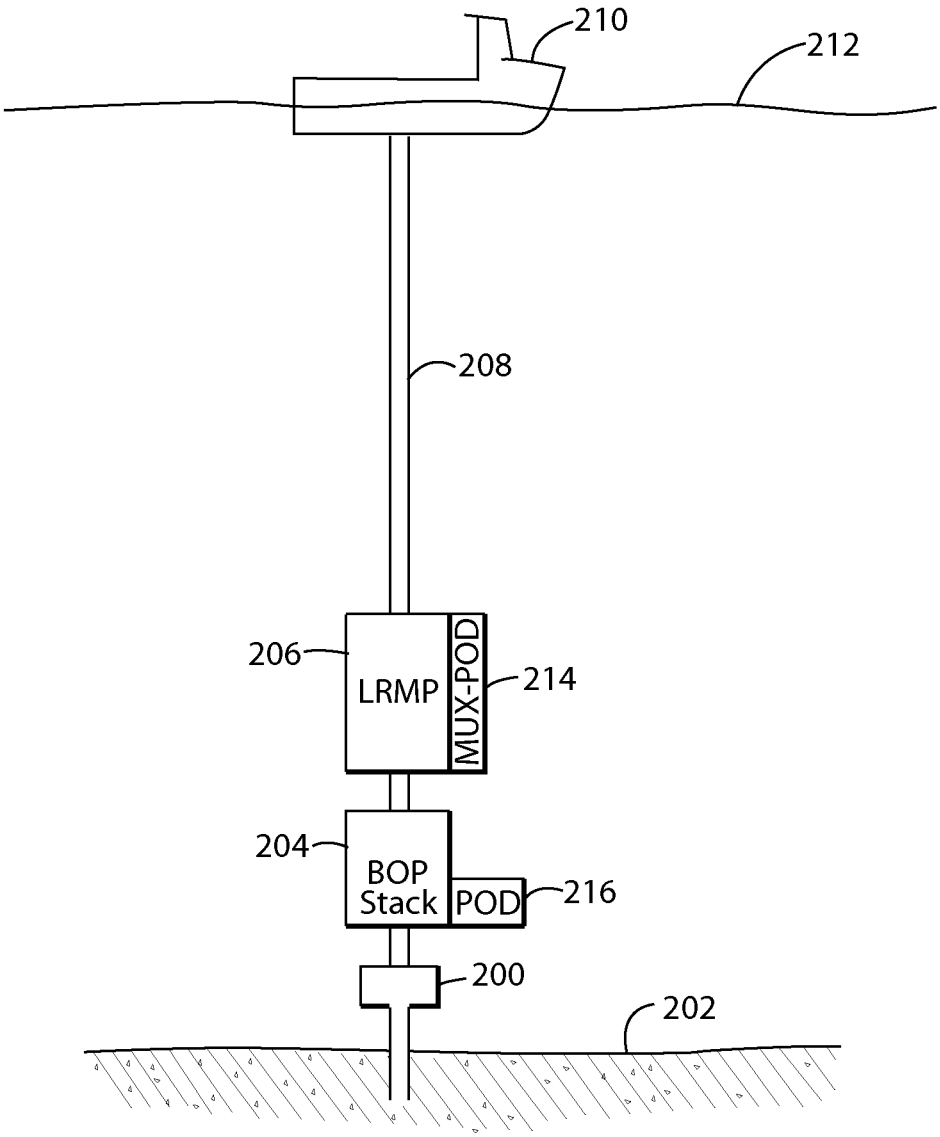
FIG. 7 is a schematic diagram of a device used to control an undersea well.

In one application, both the SPM valve 150 and the pilot valve 152 are provided in the MUX POD (not shown) device. The MUX POD may be located on the lower marine riser package (LMRP) while the BOP section 140 is located on the BOP stack. In this regard, FIG. 7 schematically illustrates the possible distribution of the elements discussed above. In this exemplary embodiment, the well head 200 is connected to the sea floor 202 and also to the BOP stack 204. The BOP stack 204 is connected to the LMRP 206 which in turn is connected via a riser 208 to a ship 210 at sea level 212. The MUX POD 214, which hosts the SPM valve 150 and the pilot valve 152 may be located on the LRMP 206. In other embodiment, the SPM valve 150 and the pilot valve 152 are located in a kicker pod 216 that is located on the BOP stack 204. The kicker pod 216 may include two connecting parts, one including the SPM valve 150 and one including the pilot valve 152. The part including the SPM valve 150 may be fixedly connected to the BOP stack 204 while the part including the pilot valve 152 is removably connected to the other part. Thus, the part including the pilot valve 152 may be removed by a remote operated vehicle (ROV) from the BOP stack 204.

Returning to FIG. 6, SPM valve 150 may include various ports 150*a* to 150*d*, which are configured to block or allow a fluid flow as indicated by the figure. Port 150*b* communicates with chamber 77 of the low pressure recipient 60 and blocks a fluid communication between chamber 77 and the BOP section 140. Port 150*c* allow a communication between pressure source 170 and the BOP section 140. When activated to the other position, port 150*a* of the SPM valve 150 blocks the fluid communication with the pressure source 170 and allows fluid communication between chamber 77 and the BOP section 140. Thus, in the position not shown in FIG. 6, the fluid in the opening chamber 142 is allowed to enter chamber 77 of the low pressure recipient 60 and to close the ram block 146 (see FIG. 5) by moving piston 149 from left to right in the figure.

Figure 8:
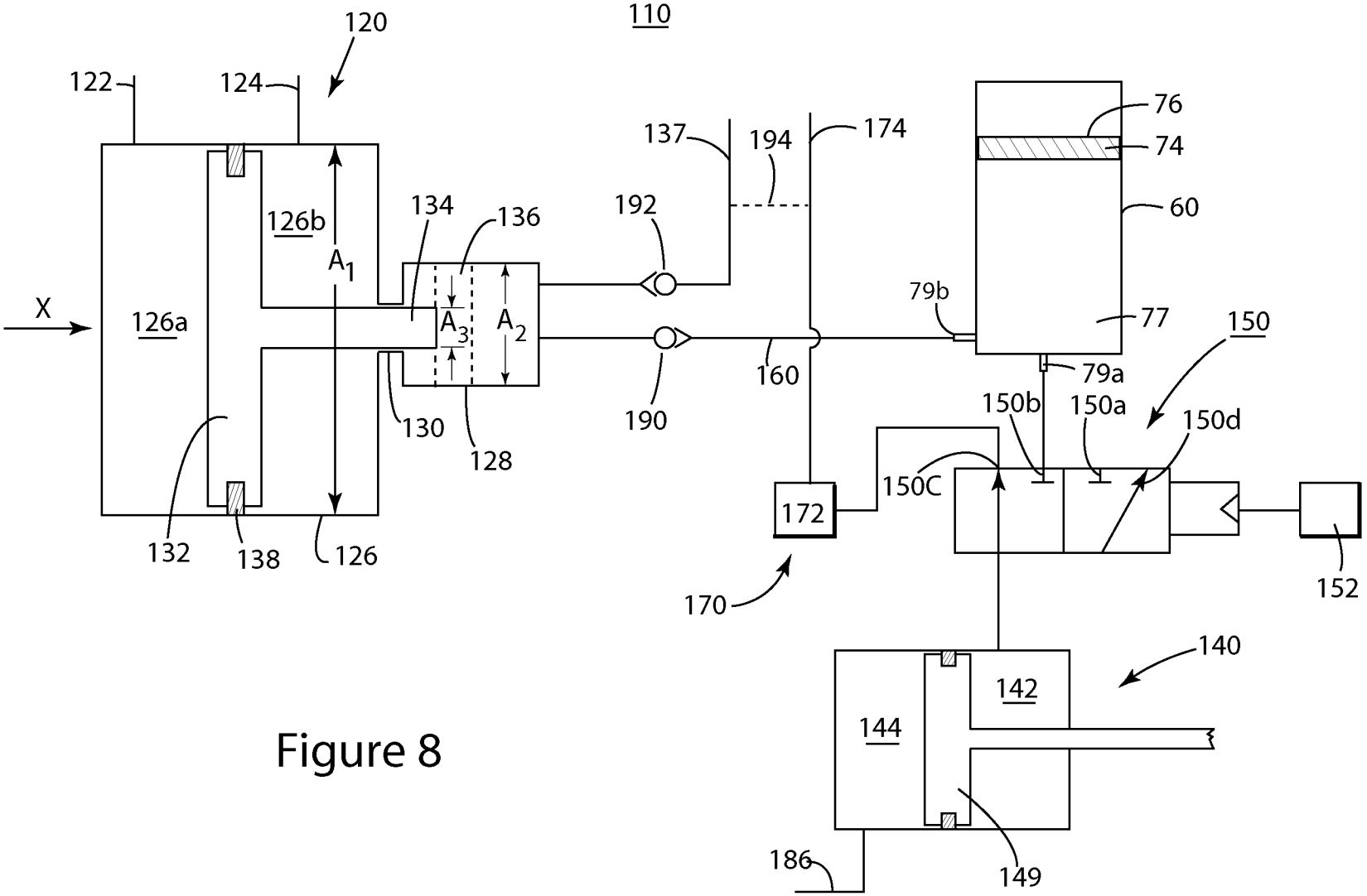
FIG. 8 is a schematic diagram of a pumping system according to an exemplary embodiment.

After this operation is performed, the SPM valve 150 moves in the position shown in FIG. 6 to block fluid communication to chamber 77. At this stage, as shown in FIG. 8, piston 74 (if the low pressure recipient 60 has not piston 74, the fluid in chamber 77 compresses the gas in chamber 76) has compressed the gas in the gas chamber 76 and chamber 77 is full with sea water. This sea water needs now to be removed so that piston 74 may come back to the initial position shown in FIG. 6. Pumping device 120 is used to achieve this functionality as already discussed.

Pressure source 170 may be used to provide the necessary high pressure for closing the ram block in the BOP section 140. The pressure source 170 may include, for example, an enclosure 172. The enclosure 172 may be configured to hold a fluid under pressure. The enclosure 172 may also be configured to directly communicate via a pipe 174 with the ship 210 for receiving more pressure under given conditions. Alternatively, the enclosure 172 may be connected to the pumping device 120, via pipe 194, to boost its pressure.

According to an exemplary embodiment, at least a pressure sensor may be provided in chamber 76 of the low pressure recipient 60 to monitor the low pressure in this chamber. Further, according to another exemplary embodiment, position detection sensors as described in U.S. Provisional Patent Application Ser. No. 61/138,005, filed on Dec. 16, 2008, to R. Judge, the entire disclosure of which is incorporated herein by reference, may be provided (i) in the pumping device 120 to detect the position of piston 132, (ii) in the low pressure recipient 60 to detect the position of piston 74, and/or (iii) in the BOP section 140 to detect the position of piston 149. Knowing some or all of the positions of the pistons 74, 132, and/or 149, may allow a controller (not shown) to control the release of high pressure from power source 170 to port 152*c* and also to control valve 152 and the pumping device 120.

Figure 9:
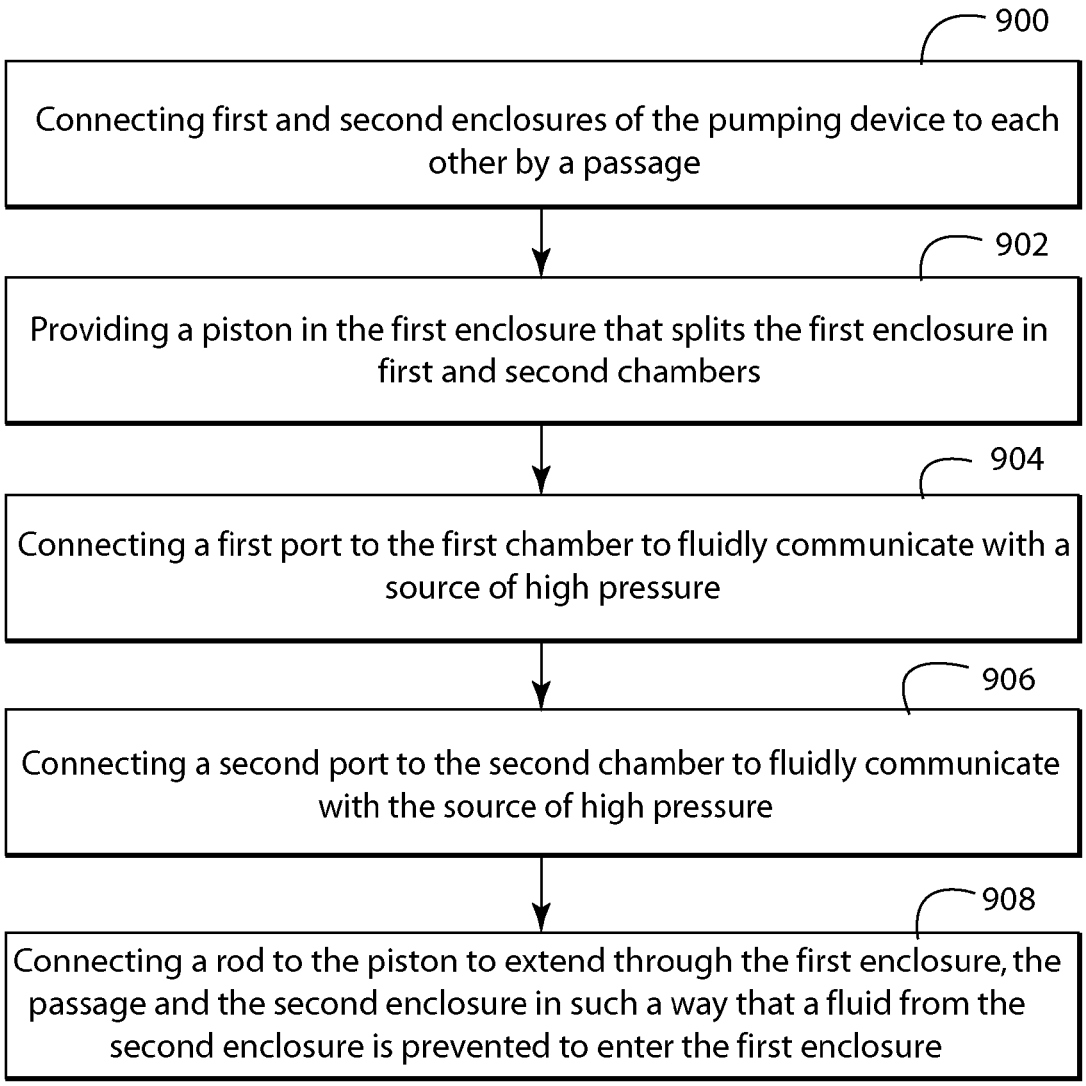
FIG. 9 is a flow chart of a method for recharging a low pressure recipient according to an exemplary embodiment.

According to an exemplary embodiment illustrated in FIG. 9, there is a method for reestablishing a low pressure in a low pressure recipient with a pumping device. The method includes a step 900 of connecting first and second enclosures of the pumping device to each other by a passage, a step 902 of providing a piston in the first enclosure that splits the first enclosure in first and second chambers, a step 904 of connecting a first port to the first chamber to fluidly communicate with a source of high pressure, a step 906 of connecting a second port to the second chamber to fluidly communicate with the source of high pressure, and a step 908 of connecting a rod to the piston to extend through the first enclosure, the passage and the second enclosure in such a way that a fluid from the second enclosure is prevented to enter the first enclosure.

The disclosed exemplary embodiments provide a device and a method for repeatedly recharging a low pressure recipient. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A recharging mechanism for use with a subsea pressure control device comprising:

A vessel having a first vessel chamber and a second vessel chamber that is sealed and contains a gas;

A vessel piston in the vessel that defines a barrier between the first and second vessel chambers, and that is selectively moveable between a low pressure position with a volume of the second vessel chamber greater than a volume of the first vessel chamber to a high pressure position with the volume of the first vessel chamber greater than the second vessel chamber;

A selector valve for selectively communicating the first vessel chamber with a ram actuator of a blowout preventer (BOP), so that when the ram actuator actuates a ram in the BOP, a fluid is discharged from the ram actuator to fill the first vessel chamber and urge the vessel piston to the high pressure position and compress the gas in the second vessel chamber;

A pumping device having a pump primary piston, a first pump chamber and a second pump chamber, the primary piston being movable within the second pump chamber of the pumping device and having a rod portion extending into the first pump chamber to change the volume of the first pump chamber when the primary piston and the rod portion move, the first pump chamber being in fluid communication with the first vessel chamber via an intake fluid line, so that as the piston moves in an intake direction and increases the volume of the first pump chamber, a pressure imbalance is created between the first pump chamber and the first vessel chamber so that fluid passes from the first vessel chamber to the first pump chamber via the fluid intake line, thereby decreasing the volume of the first vessel chamber;

A hydraulic line connected to the first and second pump chambers that delivers hydraulic fluid to drive the pump primary piston;

A discharge fluid line leading from the first pump chamber that discharges fluid from the first pump chamber when the primary piston and rod portion are moving in a discharge direction; and Valve means in the intake fluid line and in the discharge fluid line for preventing fluid in the discharge fluid line from flowing into the first pump chamber while the primary piston moves in the intake direction, and for preventing fluid in the first pump chamber from flowing through the intake fluid line into the first vessel chamber while the primary piston is moving in the discharge direction.

2. The recharging mechanism of claim 1, further comprising:

an auxiliary piston on the rod portion that divides the first pump chamber into a first auxiliary chamber and a second auxiliary chamber, the first auxiliary chamber being in fluid communication with the first vessel chamber via the intake line so that as the auxiliary piston moves kin the intake direction, a volume of the first auxiliary chamber increases, thereby creating a pressure imbalance between the first auxiliary chamber and the first vessel chamber so that fluid passes through the intake line from the first vessel chamber to the first auxiliary chamber, thereby decreasing the volume of the first vessel chamber; and the discharge line being connected to the first auxiliary chamber so that movement of the auxiliary piston in the discharge direction discharges fluid from the first auxiliary chamber.

3. The recharging mechanism of claim 1, wherein the discharge line comprises a venting pipe for venting fluid in the first pump chamber into ambient sea water.

4. The recharging mechanism of claim 2, wherein a cross-sectional area of the primary piston is larger than a cross-sectional area of the auxiliary piston so that as the auxiliary piston moves it amplifies the pressure imbalance between the first auxiliary chamber and the first vessel chamber.

5. The recharging mechanism of claim 1, wherein the volume of the first pump chamber is equal to or greater than the volume inside the first vessel chamber, so that all of the fluid in the first vessel chamber can be pulled into first pump chamber with one stroke of the pump primary piston.

6. A recharging mechanism for use with a subsea pressure control device, comprising:

a vessel for controlling subsea equipment, the vessel having a charged state in which the vessel is substantially filled with gas, and a discharged state, in which the vessel is substantially filled with fluid;

a pump that includes a pump primary enclosure having a pump primary piston that divides the pump primary enclosure into first and second primary chambers;

an auxiliary pump enclosure having an auxiliary piston rigidly connected to the primary piston, the auxiliary piston dividing the auxiliary pump enclosure into first and second auxiliary chambers, the first auxiliary chamber having a volume that increases as the primary piston moves the auxiliary piston in an intake direction, the first auxiliary chamber being hydraulically connected to the vessel via an intake line;

at least one hydraulic line connected to the pump primary enclosure to drive the pump primary piston across the pump primary enclosure in the intake direction, thereby increasing the volume of the first auxiliary chamber as the auxiliary piston moves in the intake direction and drawing fluid out the vessel through the intake line into the first auxiliary chamber;

a discharge line extending from the first auxiliary chamber for discharging fluid from the first auxiliary chamber when the primary piston moves the auxiliary piston in the discharge direction; and an intake line valve that prevents flow from the first auxiliary chamber into the vessel when the auxiliary piston moves in the discharge direction.

7. The recharging mechanism of claim 6, wherein the discharge line comprises a venting pipe for discharging fluid from the first auxiliary chamber subsea as the auxiliary piston moves in the discharge direction.

8. The recharging mechanism of claim 6, wherein:

the auxiliary piston has a diameter smaller than the diameter of the primary piston to amplify the force of the primary piston in drawing fluid from the vessel into the first auxiliary chamber.

9. The recharging mechanism of claim 6, wherein the volume of the first auxiliary chamber is equal to or greater than the volume inside the vessel, so that all of the fluid in the vessel can be pulled into the first auxiliary chamber with one stroke of the pump primary piston.

10. A subsea well drilling blowout assembly (BOP), comprising:

A BOP piston located in a BOP chamber and movable between an open and a closed position:

A vessel in fluid communication with the BOP chamber for receiving fluid from the BOP chamber as the BOP piston is moved toward the closed position;

A pump having a primary piston and first and second primary pump chambers, the primary piston being movable in the second pump chamber and having a rod portion of smaller diameter than the primary piston and extending into the first pump chamber to increase a volume of the first pump chamber when the primary piston and the rod portion are moved in a fluid intake direction;

A hydraulic line connected to the first and second pump chambers that delivers hydraulic fluid to drive the primary piston in the fluid intake direction and in a fluid discharge direction;

An intake line leading from the vessel to the first pump chamber for drawing fluid from the vessel while the primary piston moves in the fluid intake direction:

A discharge line leading from the first pump chamber to discharge fluid from the first pump chamber while the primary piston moves in the fluid discharge direction; and An intake line valve that prevents fluid from flowing from the first pump chamber back into the vessel while the primary piston is moving in the fluid discharge direction.

11. The assembly of claim 10, wherein the discharge line comprises a venting pipe for discharging fluid from the first pump chamber into surrounding sea water as the primary piston moves in the fluid discharge direction.

12. The assembly of claim 10, wherein the volume of the first pump chamber is equal to or greater than the volume of the vessel, so that all of the fluid in the vessel received from the BOP chamber can be pulled into first pump chamber with one stroke of the primary piston.

13. The assembly of claim 10, wherein the vessel is completely sealed other than through the intake line.

* * * * *